US005916110A

United States Patent [19]

Sanfilippo et al.

[11] Patent Number: 5,916,110

[45] **Date of Patent: *Jun. 29, 1999**

[54] SYSTEM AND METHOD FOR SEALING CONTAINERS

[76] Inventors: James J. Sanfilippo, 505 N. Lake Shore Dr. #6806, Chicago, Ill. 60611; John E. Sanfilippo, P.O. Box 952, Barrington, Ill. 60011

[ * ] Notice: This patent issued on a continued prosecution application filed under 37 CFR 1.53(d), and is subject to the twenty year patent term provisions of 35 U.S.C. 154(a)(2).

[21] Appl. No.: 08/703,047

[22] Filed: Aug. 26, 1996

Related U.S. Application Data

[62] Division of application No. 08/525,409, Sep. 8, 1995, which is a continuation of application No. 08/245,249, May 17, 1994, abandoned, which is a continuation-in-part of application No. 08/122,388, Sep. 16, 1993, Pat. No. 5,417,255.

[51] Int. Cl.[6] ..... B65B 31/00

[52] U.S. Cl. ..... 53/510; 53/511; 53/432; 141/63; 141/64

[58] Field of Search ..... 53/284.5, 319, 53/281, 432, 433, 485, 471, 488, 489, 510, 511; 141/63, 64, 70, 93, 129

[56] References Cited

U.S. PATENT DOCUMENTS

| | | | |
|---|---|---|---|
| 268,477 | 12/1882 | Fish . | |
| 789,699 | 5/1905 | Lorenz . | |
| 1,406,380 | 2/1922 | Heath et al. . | |
| 1,639,828 | 8/1927 | Wheeler et al. . | |
| 1,928,903 | 10/1933 | Manning . | |
| 1,940,013 | 12/1933 | Petersen . | |
| 2,131,876 | 10/1938 | Hurst . | |
| 2,199,565 | 5/1940 | Kantor . | |
| 2,227,190 | 12/1940 | Kornquest . | |
| 2,240,655 | 5/1941 | Kornquest . | |
| 2,362,799 | 11/1944 | Boyd et al. . | |
| 2,439,773 | 4/1948 | Hohl et al. | 226/82 |
| 2,519,353 | 8/1950 | Cassady . | |
| 2,521,746 | 9/1950 | Preis . | |
| 2,534,305 | 12/1950 | Sharf . | |
| 2,630,958 | 3/1953 | Hohl . | |
| 2,649,671 | 8/1953 | Bartelt . | |
| 2,660,352 | 11/1953 | Renard . | |
| 2,768,487 | 10/1956 | Day et al. . | |
| 2,869,301 | 1/1959 | Stover . | |
| 2,978,336 | 4/1961 | Morrison . | |
| 3,056,244 | 10/1962 | Bartels | 53/432 |
| 3,087,823 | 4/1963 | Hein et al. . | |
| 3,103,771 | 9/1963 | Grafingholt . | |
| 3,117,873 | 1/1964 | Bartels et al. | 53/432 |
| 3,220,153 | 11/1965 | Cormack, Jr. et al. . | |
| 3,220,157 | 11/1965 | Buchner . | |
| 3,340,668 | 9/1967 | Bofinger . | |

(List continued on next page.)

FOREIGN PATENT DOCUMENTS

| | | |
|---|---|---|
| 447131 | 3/1948 | Canada . |
| 463300 | 2/1950 | Canada . |
| 1309992 | 9/1989 | Canada . |
| 0 184 166 | 6/1986 | European Pat. Off. . |
| 33 23 710 A1 | 10/1985 | Germany . |
| 0139313 | 5/1990 | Japan . |
| 466 786 | 1/1969 | Switzerland . |
| 551271 | 2/1943 | United Kingdom . |
| 2 086 834 | 5/1982 | United Kingdom . |
| 2 217 672 | 11/1989 | United Kingdom . |
| WO 95/31375 | 11/1995 | WIPO . |

*Primary Examiner*—James F. Coan
*Assistant Examiner*—Gene L. Kim
*Attorney, Agent, or Firm*—Brinks Hofer Gilson & Lione

[57] ABSTRACT

A controlled environment sealing system and method of operating the same. The controlled environment sealing system having a transport system for transporting containers between processors, a lid placement processor positioning lids on the containers, a controlled environment processor providing the containers with a controlled environment and pre-sealing the lids to the containers, and a permanent sealing processor permanently sealing the lids to the containers in a contaminating environment.

7 Claims, 4 Drawing Sheets

U.S. PATENT DOCUMENTS 3,347,534 10/1967 Dawson .
3,415,310 12/1968 Kulhmann .
3,466,841 9/1969 Rausing .
3,486,295 12/1969 Rausing et al. .
3,488,915 1/1970 Delestatius .
3,508,373 4/1970 Robinson, Jr. .
3,511,022 5/1970 Finley et al. .
3,545,160 12/1970 Jantze et al. .
3,584,661 6/1971 Riesenberg .
3,619,975 11/1971 Johnson et al. .
3,676,673 7/1972 Coleman .
3,708,952 1/1973 Schulze et al. .
3,807,052 4/1974 Troue .
3,837,137 9/1974 Yatsushiro et al. .
3,860,047 1/1975 Finkelmeier et al. .
3,861,116 1/1975 Domke .
3,871,157 3/1975 Domke et al. ..... 53/510
3,881,300 5/1975 Zetterberg .
3,910,009 10/1975 Canfield .
3,936,950 2/1976 Troue .
3,939,287 2/1976 Orwig et al. .
3,942,301 3/1976 Domke .
4,014,153 3/1977 Wilson .
4,014,158 3/1977 Rausing .
4,016,705 4/1977 Wilson et al. .
4,027,450 6/1977 Chiu et al. .
4,094,121 6/1978 Ganholt .
4,140,159 2/1979 Domke .
4,148,933 4/1979 Janovtchik .
4,154,044 5/1979 Lang .
4,458,734 7/1984 Scholle et al. .
4,498,508 2/1985 Scholle et al. .
4,602,473 7/1986 Hayashi et al. .
4,658,566 4/1987 Sanfilippo .
4,696,226 9/1987 Witmer .
4,703,609 11/1987 Yoshida et al. .
4,733,818 3/1988 Aghnides .
4,768,326 9/1988 Kovacs .
4,791,775 12/1988 Raque et al. .
4,823,680 4/1989 Nowotarski .
4,827,696 5/1989 Arends et al. .
4,831,811 5/1989 Nixon, Jr. et al. .
4,905,454 3/1990 Sanfilippo et al. .
4,941,306 7/1990 Pfaffmann et al. .
4,962,777 10/1990 Bell .
4,964,259 10/1990 Yivisaker et al. .
4,982,555 1/1991 Ingemann .
4,996,071 2/1991 Bell .
5,001,878 3/1991 Sanfilippo et al. ..... 53/510
5,054,265 10/1991 Perigo et al. ..... 53/488
5,069,020 12/1991 Sanfilippo et al. .
5,071,667 12/1991 Grüne et al. .
5,159,799 11/1992 Rising et al. .
5,178,841 1/1993 Vokins et al. ..... 53/432
5,228,269 7/1993 Sanfilippo et al. .
5,230,203 7/1993 Wu et al. ..... 53/471
5,247,746 9/1993 Johnson et al. .
5,323,589 6/1994 Linner .
5,417,255 5/1995 Sanfilippo et al. .

SYSTEM AND METHOD FOR SEALING CONTAINERS

RELATED APPLICATIONS

"This application is a division of application Ser. No. 08/525,409, filed Sep. 8, 1995, (pending), which is a continuation-in-part of application Ser. No. 08/122,388, filed Sep. 16, 1993, which issued as U.S. Pat. No. 5,417, 255."

FIELD OF THE INVENTION

The invention relates to a method and system for sealing containers. In particular, this invention relates to a system and method of pre-sealing a lid on a container to retain a vacuum and/or inert environment within the container, and then permanently sealing the container in an atmospheric, oxygen contaminated environment.

BACKGROUND OF THE INVENTION

In the food packaging industry various techniques exist for sequentially exposing containers of food product to a vacuum or to an inert atmosphere to substantially reduce the oxygen level, and for sealing the container to retain the applied vacuum or atmosphere and thereby preserve freshness of the food products. Existing systems have limitations which reduce the efficiency and speed of the packaging operation. In addition, certain packaging system designs remove the choice of using a variety of modern filling and seaming equipment.

The problem becomes more acute when considering processes that require vacuum packaging. For example, the coffee industry requires vacuum packing to remove destructive oxygen thereby minimizing degradation of flavor volatiles and reducing the effect of the ground roasted coffee out-gassing for overall consumer acceptance. Within a twenty-four hour period after the coffee is ground and roasted a relatively high percentage of carbon dioxide within the coffee is gassed off. Existing coffee packaging systems generally provide a vacuum of between about 27–28 inches of mercury (wherein zero inches being atmospheric pressure and approximately 30 inches being a perfect vacuum) to the filled coffee containers to substantially remove the majority of destructive oxygen. This level of reduced pressure accommodates the gassing off and retains an adequate negative pressure to protect flavor volatiles within a permanently sealed container. If the container is exposed to an inadequate vacuum, a positive pressure may develop (depending on the product hold time after the coffee is ground and roasted) within the container as a result of the normal out-gassing which could project coffee out of the container upon opening. Inadequate vacuum also would expose the coffee to a higher oxygen level both reducing equivalent shelf life and flavor impact upon consuming. This is both undesirable and potentially hazardous to the consumer.

Existing coffee packing systems have cumbersome seamer operations within a vacuumized chamber. These systems are cumbersome and inefficient having complex seaming rolls, substantial vacuum pumps, and air locks with metal on metal sealing chambers which require frequent maintenance due to the excessive wear. In operation, the filled containers pass through a clincher which partially crimps a lid onto a container to ensure the lid is retained on the container as it processed. Next, the container with lid passes through a two-stage airlock, with an initial stage at a pressure of for example approximately 15 inches of mercury.

The second stage communicates with the main vacuum chamber with a pressure of approximately 27–28 inches of mercury. The residence time required in the air lock effectively limits the line speed of the packaging process to approximately 100–150 containers per minute (depending on end vacuum levels). The extreme vacuum ramp up in the two stage airlock causes a high degree of turbulence within the seaming chamber which contributes to the formation of a coffee dust blanket which is extremely corrosive and destructive to the seaming rolls and mechanics of the equipment. The containers next are fed into the double seamer which is enclosed within the vacuum chamber. The location of the seamer within the chamber complicates the maintenance of the seamer and requires substantial energy expenditure to continuously evacuate the large seaming chambers. After seaming, the containers are released to atmosphere through another two stage air lock.

It would be desirable to have a sealing system that would accommodate both atmospheric pressure (e.g. inert gas) and vacuum packed products. A system providing a pre-seal prior to seaming would eliminate the need for the seaming equipment to reside within the inert gas environment or vacuum chamber. An incremental vacuumization processor, where vacuum sealing is desired, would allow the line speed of the system to be increased, such as to four times the existing line speeds by gradually pulling vacuum over many stages rather than abruptly pulling vacuum in two stage air locks. In addition, the incremental vacuumization and pre-seal operation followed by double seaming external of the vacuum chamber would eliminate the corrosive and destructive dust from damaging or wearing the high tolerance double seaming rolls and components. It would also be desirable to provide an inert gas environment in the input transportation system and filling system to reduce oxygen levels and accommodate less vacuumization. The lower vacuum levels would allow for light-weighting of the containers and lids.

Wet vacuumization processes used for packaging some vegetables, pasta and tomato sauce products, meat products, chili, soups, and other food products with moisture are also inefficient and cumbersome. These processes require filling open containers with the cooked food product at high temperature and exposing it to super-heated steam as it is transported to the seaming station. The steam exposure continues during the double seaming process. The steam effectively displaces the air in the container and, as the container cools, a vacuum is formed within the container. After the container is seamed, it is generally fed through a vertical or horizontal retort tank. The tank is filled with high temperature water and/or steam. The container remains in the tank for a minimum period of time sufficient to guarantee an effective kill of desired bacteria and other microbes. The exact period of residence time in the retort tank is determined by the thermal death curve which is product and container dependant. This time/temperature critical process is particularly important to kill pathogens, especially botulism which can cause illness or death if ingested. The retorting operation is a mandatory safety process and must be done to the full time/temperature minimum regardless of the prior cooking and steam exposure.

It would be desirable to have a system that would eliminate the need for filling with hot product and applying super-heated steam to the container during transportation and the seaming process. This would reduce energy costs and help improve the overcooked texture of many products which are recooked not only by the super-heated steam process, but again in the retort tank. An effective high speed system providing a pre-seal in a vacuumized environment would eliminate the need for steam purging during the double seam process. Inert gassing during transportation to the filler and pre-sealing stations, and inert gassing of the product in the filling station, would also eliminate the need for steam purging during transportation of the containers to the seamer.

One problem that arises in providing an effective pre-seal is the frequent imperfections that occur during shipment and handling of the containers. These imperfections include dents and indentions on the exposed flange and upper flange radius about the container opening. In addition, oblong or out of round container openings often result from shifting during shipping. These irregularities are acceptable in the canning industry because they are accommodated by the standard double seamers that operate to restore the container shape during seaming. In addition, the standard double seam lids have a curl portion which is folded into the flange thus avoiding the imperfections on the exposed flange and upper exposed flange radius.

These imperfections on the flange radius, however, would affect pre-sealing a standard double seam lid to the flange radius of the container. The various dents and indentations would provide a path between the mating surfaces of a draw portion of the standard lid and the flange radius and allow the vacuumized or inert environment to become contaminated when exposed to an atmospheric or other contaminating environment. It would accordingly be desirable to have a system that would provide a lid having a slightly deeper draw, if desired, with a slightly increased radius, that would allow the lid to seal against the lower flange radius and interior surface of the container to avoid the imperfections on the flange radius and provide an effective pre-seal. The increased draw radius would facilitate a plunger assisted insertion of the lid into a misshapen container opening during the pre-sealing process.

SUMMARY OF THE INVENTION

The invention provides a system for sealing containers, and method of operating the same. The system comprises a transport system for transporting containers between processors, a controlled environment processor providing at least the interiors of the containers with a controlled environment and pre-sealing lids to the containers, and a permanent sealing processor or permanently sealing the lids to the containers.

The invention further provides additional features including the controlled environment processor comprising a chamber and vacuum source exposing the container to a reduced pressure, and a lid placement system adjacent an entry of the chamber. The controlled environment processor may include a relief system for repressurizing the chamber after the interior of the container has been reduced in pressure. The lid may be temporarily pre-sealed to the container prior to repressurizing, or may be abruptly forced into a pre-sealed engagement by the pressure differential resulting from repressurization. The lid thereafter maintains a sealing engagement with the container due to the pressure differential between the outside and inside of the container, which may be aided by various gaskets or adhesives if desired. The controlled environment processor could preferably include a multi-chambered cambered Belt-Vac® processor as described in U.S. Pat. No. 4,658,566.

The invention further provides additional features including: a gasket for providing a pre-seal contact surface; the gasket comprising an adhesive or a food grade material or compound; the lid comprising a seam-on lid having a curl portion, and a draw portion, the container having a flange formed on a top peripheral portion of the open container, the flange having a flange radius, the draw portion having an extended surface for pre-sealing against an interior surface of the container beneath the flange radius; and the curl portion of the lid seamed to the flange of the pre-sealed container in a standard atmospheric double seamer.

The invention further provides a container sealing system comprising: a pre-purging rail, a filling station, a controlled environment pre-sealing station, and a permanent sealing station. The pre-purging rail may have a longitudinally oriented region providing a laminarized flow of inert gas into open containers being transported along a conveyer. The filling station may include a hopper, and a filler. The hopper has at least one gassing region for providing a laminarized flow of inert gas into the hopper. The filler has a filling head and a gassing region oriented around the periphery of the filling head for providing a laminarized flow of inert gas around the filling head. The controlled environment sealing station may include a lid turret and a controlled environment processor positioned adjacent the lid turret. The lid turret positions lids on the open containers entering the controlled environment processor. The controlled environment processor exposes the filled containers to a controlled environment and pre-seals the lids on the containers. The permanent sealing station permanently seals the pre-sealed containers in a contaminated environment. In addition, the system may include: a head-space purging rail having a longitudinally oriented region providing a laminarized flow of inert gas into the filled open containers being transported along a conveyer; the permanent sealing station comprising a standard atmospheric double seamer; the controlled environment comprising a sub-atmospheric environment; and the controlled environment processor having a plunger member applying pressure to a outer upper surface of the lid to engage a draw portion of the lid with the lower flange radius and inner diameter surface of the container.

The invention further provides a method of operating a container sealing system. An open container is filled with food product. The filled container is then exposed to a select controlled environment. A lid is pre-sealed on to the filled container within the controlled environment. The pre-sealed container may then be transported through a contaminating environment (such as an oxygen containing ambient atmosphere) for a period of time. This period is sufficient to allow the processed container to be transported to and sealed by standard atmospheric seamers, thus eliminating the need for complex vacuum or inert environment transport and seaming. The lid is then permanently sealed on to the pre-sealed container. If desired, the ability to transport and temporarily store the pre-sealed containers in contaminating environments permits the seamers to be located remotely from the environmental processor(s); for buffer queuing of pre-sealed containers to accommodate differing speeds of the various devices; or to accommodate temporary downtime of the seamer(s) without loss of product. In addition, the method provides for flushing the open container moving along a conveyer to a filling station with a laminarized flow of inert gas, and exposing food product in the filling station to a laminarized flow of inert gas; flushing a head space region of the filled container moving along a conveyer from the filling station; and transporting the pre-sealed container from the controlled environment through a contaminated environment.

The invention provides for other features of the method including: the controlled environment comprising a sub-atmospheric environment; the pre-sealing comprising exposing the exterior of the container and lid to a higher pressure than the sub-atmospheric pressure to create a pressure differential between the interior and exterior of the container; the lid having a draw portion, the container having a flange portion with a flange radius, the draw portion pre-sealing against an inner diameter surface of the container and lower flange radius; the lid having a curl portion, the permanent sealing comprising seaming the flange portion with the curl portion to create a double seam; the container comprising a pre-purged container filled with inert gas flushed product; and the select controlled environment comprising a reduced pressure, the pressure incrementally decreased in a multi-chambered Belt-Vac® processor.

The invention provides the foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
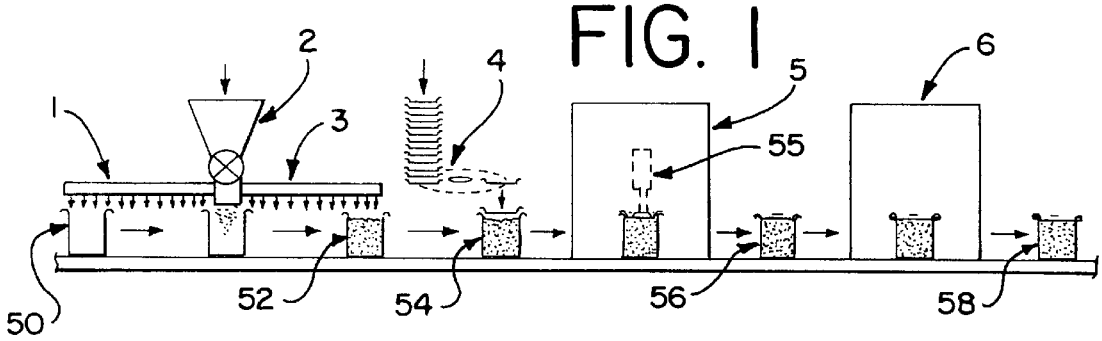
FIG. 1 is a schematic view of the container sealing system.

Referring to FIG. 1, a schematic view of the controlled environment sealing system is shown having a pre-purging rail 1, filling station 2, head-space purging rail 3, lid placement system 4, controlled environment processor 5, and seamer station 6. In a preferred embodiment for the packaging of coffee, vegetables, meat products, or other food products requiring a vacuum packing, the controlled environment processor 5 would have one or more chambers or other structures connected to a vacuum source that would allow at least the interiors of the containers to be exposed to reduced pressure. Existing controlled environment processors including the "bell jar" processor as shown for example in U.S. Pat. No. 2,292,887, batch chambered processors for vacuumizing multiple containers in one chamber, head systems cooperating directly with the container opening, and multi-chambered processors including the Belt-Vac® as shown in U.S. Pat. No. 4,658,566. Other forms of vacuum chamber processors could similarly be used for vacuumizing the containers. It is further understood that multiple stages of vacuum, at the same or differing pressure, and inert gas flushing in conjunction with vacuumizing (either sequentially or simultaneously) may be employed.

In operation of a particularly preferred embodiment, an empty, open container 50 may be exposed to a laminarized flow of inert gas from the pre-purging rail 1 which reduces the oxygen levels within the container from 20.9% to less than 2.0% residual oxygen. The filler station 2 preferably has gassing element regions in the hopper, transfer chute, auger, and filler head to provide a laminarized flow of inert gas to substantially reduce oxygen levels from the product and prevent reintroduction of oxygen during filling of the pre-purged container. The head-space purging rail 3 further flushes the head-space of the filled container 52 with a laminarized flow of inert gas to maintain the inert environment as the container is transported to the controlled environment processor. Adjacent the controlled environment processor 5 is a lid placement system 4 where a lid may be positioned loosely over the container opening 54. The container next enters a processing chamber, such as a vacuum chamber, of the controlled environment processor where it is exposed to e.g. a reduced pressure atmosphere. As the pressure is returned to atmospheric, the lid forms a temporary seal with the container due to the pressure differential on the inside and outside of the container. Alternatively, a mechanical plunger 55 (shown in phantom) is preferably used to press the lid into position during the vacuumization procedure to assure the necessary surface contact needed to form the vacuum pre-seal. The plunger may also aid in correcting the misshapen container opening by forcing the lid into the opening. The pre-sealed container 56 may then be transported through a contaminating environment to the permanent sealing station 6 where the lid is double seamed onto the container 58.

The preferred inert gassing of the product in the filling station, and the pre-purging and head-space purging of the container, provide for low oxygen residual in the filled container. This low oxygen residual reduces the need for exposing the container to a high level vacuum (27–28 inches of mercury) in the controlled environment processor, which is normally required in existing processes to reduce oxygen to acceptable levels. In the coffee industry, some vacuum (approximately 10–20 inches of mercury) is required for consumer acceptance, and to accommodate the normal gassing off of carbon dioxide from the ground roasted coffee. An added benefit of the lower vacuum requirement is the accommodation of light-weighted (reduced metal weight) containers and lids. The reduced pressure requirements of the container will allow for light-weighting of the standard coffee container or the replacement of the metal container with a composite container (e.g. cardboard with foil liner).

Figure 2:
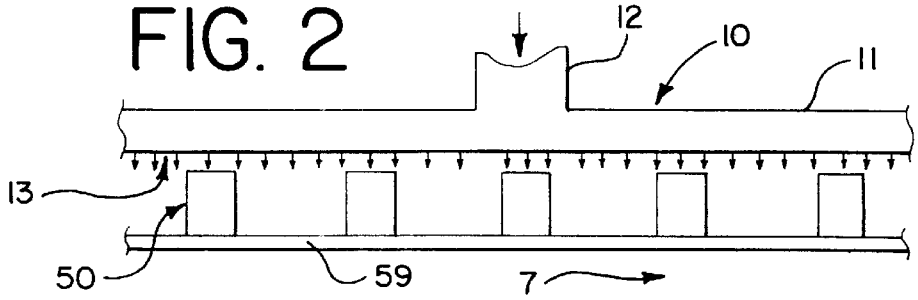
FIG. 2 is a side view of a gas purging rail including the pre-purging and head-space purging rail longitudinally disposed above a row of open-top containers being transported by a conveyor.
Figure 3:
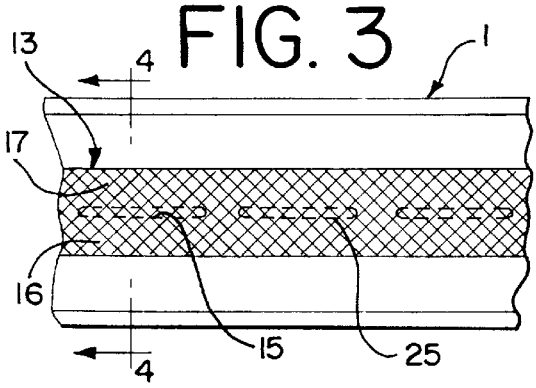
FIG. 3 is a sectional view of the pre-purging rail of FIG. 2, taken along the line 3—3 in FIG. 2 and showing the bottom outer face of the gas distribution manifold with the slots formed in the upper screen shown in phantom.
Figure 5:
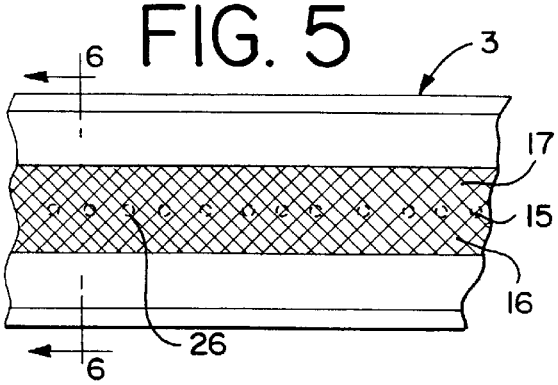
FIG. 5 is a sectional view of the head-space purging rail of FIG. 2, taken along the line 3—3 in FIG. 2 and showing the bottom outer face of the gas distribution manifold with the holes formed in the upper screen shown in phantom.

Referring to FIG. 2, the gas purging rail 10, representing both the pre-purging rail 1 and head-space purging rail 3, is disposed along and above a row of open-top containers 50 traveling on a conveyor 59 along the purging rail 10 in a direction of travel designated by arrow 7. The gas purging rail 10 includes a longitudinal plenum 11 having an inlet 12 for receiving inert gas from a single source (not shown) and a distribution manifold 13 for distributing inert gas into the open containers. The distribution manifold 13 is located on a bottom surface of the plenum 11, longitudinally oriented with respect to the plenum 11, parallel to the conveyor 59 and parallel to the direction of travel 7 of the containers.

The vertical distance between the manifold 13 and the tops of the open top containers is small, and ideally should not exceed about 0.375 inches for the embodiment of FIGS. 1–6. Preferably for standard 401 containers, this vertical distance is between about 0.125 and about 0.250 inches, most preferably between about 0.175 and about 0.200 inches. For 401 cans, as shown in the embodiment of FIGS. 1–6, the plenum 11 has a height of about 1.0 inch, a length of about 4 feet, and a width of about 5.0 inches. Each of the containers 50 is a standard 401 container having a height of 5.438 inches and an outer diameter of 4.1 inches. The inert gas has an inlet and an outlet flow rate of about 2 to about 15 cubic feet per minute, for this embodiment. The optimum inert gas flow rate will vary depending on the lines speed and container dimensions. The optimum flow rate can be determined through wind tunnel testing of the various sized containers.

Preferably, the plenum 11 is closed except for the inert gas inlet 12 and the distribution manifold 13. The plenum 11 may be rectangular as shown in FIG. 2, and may be constructed of stainless steel, aluminum, rigid plastic or any other rigid material. The plenum 11 should preferably be at least as wide as, and more preferably somewhat wider than, the diameters of the open top of the containers 50. The length of the plenum 11 may vary depending on the desired line speed and minimum residence time underneath the plenum 11 for each container. Also, a plurality of plenums 11 may be arranged lengthwise in series to create a higher "effective" length. For a given residence time, the maximum line speed increases as the length of the plenum 11 is increased. For the embodiment described above, the preferred line speed is about 400 containers per minute and requires approximately 12 feet of effective plenum length.

Referring to FIGS. 3–6, the preferred distribution manifold 13 for the pre-purging rail and head-space purging rail includes a longitudinally oriented center area 15 of lower flow resistance in between and adjacent to two smaller longitudinally oriented areas 16 and 17 of higher flow resistance. Each of the flow regions 15, 16 and 17 extends the length of the bottom surface of the plenum 11, is positioned above the open tops of the containers 50, 52 and is oriented parallel to the direction of travel 7 of the containers. In the preferred embodiment, the overall width of the distribution manifold 13 is smaller than the width of the bottom surface of the plenum 11 and the diameter of the openings of the containers. This not only reduces inert gas quantities and costs but also improves the quality of the purge by providing a very desirable flow pattern, discussed below.

In the embodiment shown in FIG. 2, for instance, the bottom surface of the plenum 11 may have a width of at least about 5.0 inches as described above. The manifold 13, by comparison, may have an overall width of about 0.75–1.0 inch for containers having opening diameters of about 4–6 inches. The central region 15 of lower flow resistance may have a width of about 0.25 inch, and the surrounding regions 16 and 17 of higher flow resistance may each have a width of about 0.25–0.5 inch. Smaller containers may utilize smaller optimum manifold widths. For containers having opening diameters of about 2–3 inches, the manifold may have an overall width of 0.5 inches, with correspondingly smaller widths for the regions of higher and lower flow resistance.

Figure 4:
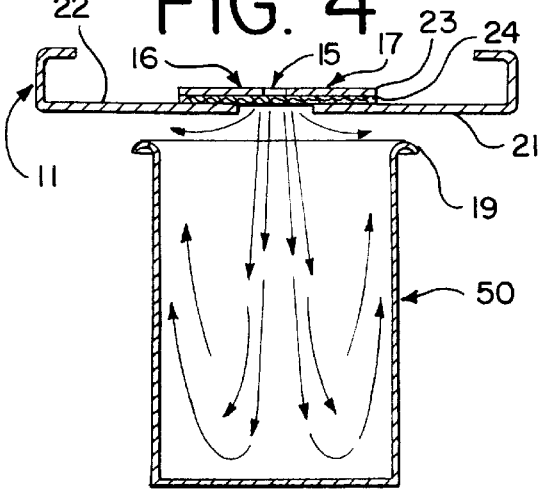
FIG. 4 is a front sectional view of a single container being purged by a pre-purging rail, taken along line 4—4 in FIG. 3.
Figure 6:
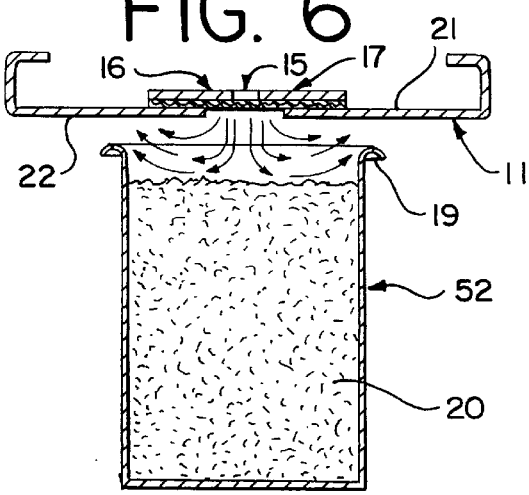
FIG. 6 is a front sectional view of a single container being purged by a head-space purging rail, taken along line 6—6 in FIG. 5.

Preferably, the distribution manifold 13 is positioned longitudinally in the center of the bottom surface of the plenum 11, and for the pre-purging rail 1 and head-space purging rail 3, shown in FIGS. 4 and 6 respectively, exactly over the centers of moving containers 50, 52. In the pre-purging rails 1 inert gas passing through the center area 15 of lower flow resistance has a relatively high velocity, sufficient to carry the gas to the bottom of each container 50. In the head-space purging rails 3, the velocity of the inert gas passing through center area 15 is sufficient to carry to the top surface of the product 20 in the filled containers 52 and overcome any air during container transport.

The arrows in FIGS. 4 and 6 show the direction of travel of the laminarized flow of inert gas. Inert gas passing through adjacent regions 16 and 17 of higher flow resistance may be partially carried into the containers 50, 52 by a "venturi" effect from the higher velocity gas. Otherwise, the gas passing through areas 16 and 17 has a lower velocity, and creates an inert gas blanket covering the tops of containers 50, 52. This inert gas blanket surrounds the higher velocity inert gas jet passing from the region 15 on both sides, protecting the higher velocity jet from mixing with surrounding air.

As shown in FIGS. 4 and 6, the flow patterns caused by injecting the higher velocity inert gas centrally through region 15 of manifold 13, act in cooperation with the inert gas blanket originating from regions 16 and 17 of manifold 13, to cause a strong positive outflow of inert gas (and any oxygen from the container carried with it) through the space between the bottom surface of plenum 11 and the rims 19 of containers 50, 52. Because the regions 15, 16 and 17 are oriented parallel to the direction of travel of the containers, the gas flow patterns (including the outflow) exist continuously and substantially at steady state for the entire time that each container remains underneath the surface of plenum 11. Therefore, there is no opportunity for oxygen to enter the containers from the outside. The oxygen content inside the containers steadily decreases as each container moves below the manifold 13 until the oxygen content is reduced to target levels or below, whereby the purging is completed.

The regions 15, 16 and 17 of high and low flow resistance can be created using adjacent welded screens of different opening size, selectively layered screens, porous plastic (e.g. porous high molecular weight high density polyethylene), porous plates, or any selectively porous material that acts as a diffuser.

Referring to FIGS. 3–6, for both the pre-purging rail (FIGS. 3–4) and the head-space purging rail (FIGS. 5–6), two rolled pieces of stainless steel members 21, 22 form the bottom face and sides of the plenum. A 2.5 inch strip of 40 micron 5-ply stainless steel screen 23 is welded upon a 2.5 inch strip of 80 micron 2-ply stainless steel screen 24 and to the rolled steel side members allowing the inert gas to pass between the side members through a one inch strip of screen forming the manifold.

In the embodiment shown in FIGS. 3–6, the pre-purging rail 1 has a series of 0.25-inch wide and 3-inch long slots 25 formed in the center of the 5-ply 40 micron screen parallel to the direction of container travel. The slots can be spaced about 0.75 inch apart from each other and provide the region of lower resistance to allow a higher velocity flow. The 0.75 inch spacing of the slots gives the rail more structural integrity, but a long continuous slot may be preferable. The screened regions on either side of the slots provide the high resistance regions 16, 17 which allow a lower velocity flow parallel to the low resistance region 15 and to the direction of container travel 7. In the head space purging rail 3, the screens are the same as the pre-purging rail 1 except for 0.25 inch diameter holes 26 are substituted for slots because of the reduced requirement for inert gas due to the container being filled with food product. The holes 26 are formed in the center of the 5-ply 40 micron screen to form the lower resistance region 15, and are spaced approximately every inch. The higher resistance flow regions 16 and 17 run parallel to the lower resistance region 15. As explained above, this particular manifold 13, having a total width of 1.0 inch, is more suitable for flushing wider containers having opening diameters of 4–6 inches.

Figure 7:
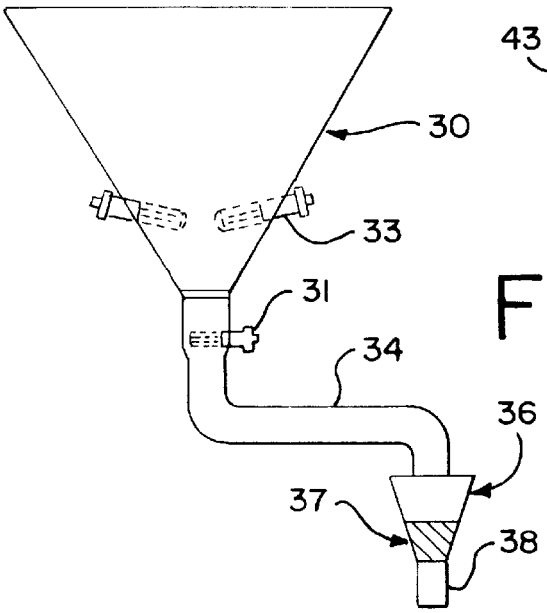
FIG. 7 is a side elevational view of the filling station.

Referring to FIG. 7, the preferred filling station is shown having a hopper 30, conduit 34, auger 36 and filler 38. Inserted through the side wall of the hopper 30, and conduit 34 are removable gassing elements 33 and 31. Formed in a lower portion of auger 36 is a gassing cone 37. In operation, dry food product is continuously fed into the hopper through an inlet (not shown). The product is continuously exposed to laminar flow of inert gas emanating from the hopper gassing elements 33.

Figure 17:
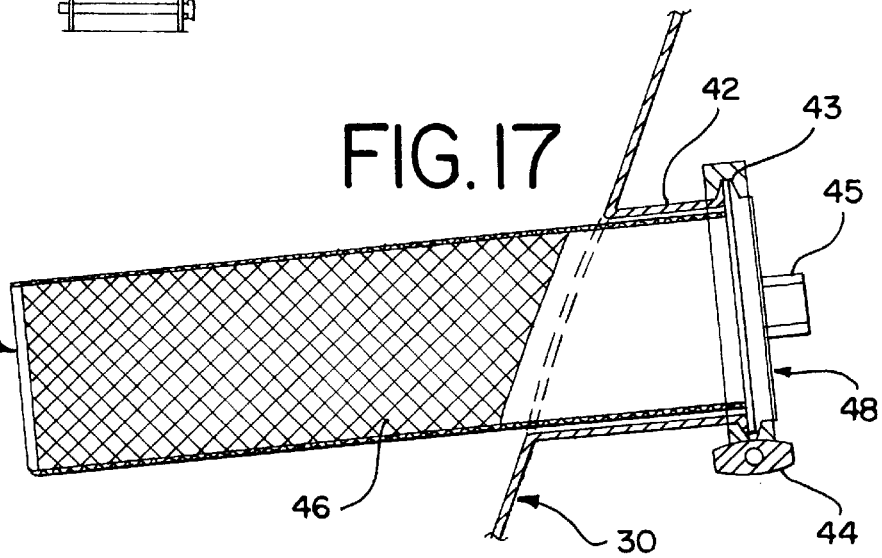
FIG. 17 is a sectional view of a gassing element mounted in a side wall of the hopper or transfer chute.
Figure 18:
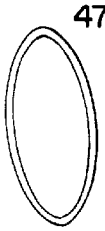
FIG. 18 is an end view of the gassing element showing the elliptical cross section.

Referring to FIGS. 15–18, a preferred hopper and transfer chute gassing system is shown. The hopper gassing elements 33 preferably have an elliptical cross section (as shown in FIG. 17) extending approximately 10 inches inward from the inner wall of a hopper. The gassing element 33 has a screened body 46, and a stainless steel cap 47 and base 48. The gassing element 33 is mounted in a socket 42 which is welded sanitary to the hopper 30. The gassing element 33 may preferably be positioned at a downward sloping angle approximately 5 degrees from horizontal. A gasket 43 is positioned between the mating surfaces of the gassing element and socket base, and secured with a sanitary clamp 44. Inert gas is regulated at a flow rate ranging between about 2–20 scfm (depending product flow rates) on through the inlet 45 through the opening formed in the center of the gassing element 33. The body of the gassing element 46 may preferably be a 5-ply 20 micron laminated stainless steel screen. The screen provides adequate resistance to distribute the inert gas about the entire surface area of the screen and provide a constant laminar flow. The hopper gassing elements operate to provide a steady laminar flow and to avoid the stratification of the product that would occur if laminar flow was not achieved. The flow rate would be determined by the number of gassing elements used, size of gassing element selected and type of product. A preferred system uses four gassing elements 33 positioned symmetrically about the hopper. The base region 48 of the gassing element extends approximately ¾ inch inward from the inner surface of the hopper to aid the flow of laminarized inert gas through the product rather than along the sidewall of the hopper.

The transfer chute gassing elements 31 are similar to the hopper gassing elements 33 except that they are slightly smaller and are oriented to allow the product to pass through smaller cross section of the transfer chute. In the diagramed embodiment, the transfer chute 34 has a diameter of ten inches, and the gassing element would extend across the diameter. Additional transfer chute gassing elements 31 would preferably be positioned beneath each other at varying degrees about the side wall of the transfer chute 34 to provide coverage of the conduit opening. The transfer chute gassing elements 31 are positioned below the hopper 30 to provide a net out flow of inert gas upwards through the product and out through a discharge outlet (not shown) located in a top portion of the hopper. The gassing elements 33, 31 can be conveniently removed for cleaning. After the gassing element is removed, a plug can be fitted in the socket 42 to prevent leaking of cleaner solution during conventional clean in place operations or routine hopper cleaning.

Figure 8:
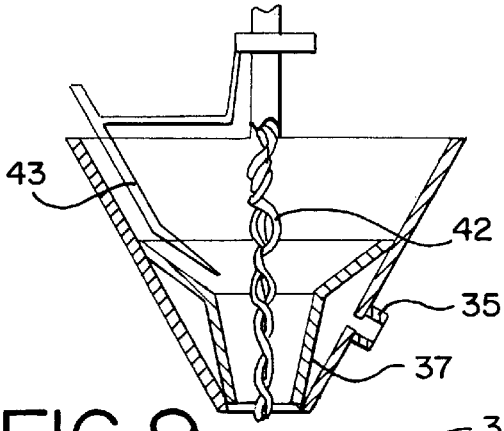
FIG. 8 is a sectional view of the auger.

As shown in FIG. 7 the transfer chute 34 is connected to an auger 36 having a gassing cone 37. Referring to FIG. 8, a sectional view of the auger is shown having an auger blade 42, peripheral blade 43, and gassing cone 37. The auger blade operates during the 0.5–2 seconds of filling time for each container (depending on container size) and distributes a consistent amount of product into the container per revolution. The agitator blade operates continuously at approximately 15 rpm and breaks up any product that would tend to accumulate along the inner wall of the auger 36. The gassing cone 37 is provided with a steady stream of inert gas through the inlet 35. The gassing cone is formed of a porous material, preferably a 5-ply 40 micron laminated stainless steel screen having an adequate resistance to distribute the inert gas stream from the inlet 35 consistently around the cone to allow for an even laminar flow over the entire surface area of the screen. The gassing cone 37 is positioned in a lower portion of the auger 36 to provide a net out flow of inert gas upwards through the product. The cone may also acts, because of the narrowed region of the cone and increased exposure of the product to gas flow, to break up any clumps of product that may have entrained oxygen.

Because the product is continuously fed into the hopper, the product that is lower in the hopper has the most exposure time to the inert gas. An exposure time of approximately 2–6 minutes is required for most food product to achieve an oxygen content in parts per million (PPM). Programmable logic controllers may be used to assure that the proper oxygen levels have been achieved by the flushing process. By monitoring the discharge for inert gas and oxygen content exiting through the discharge opening in the upper portion of the hopper 30, and monitoring at a point in the hopper prior to the gassing elements 33, the logic controllers can continuously adjust the inert gas flow and exposure time of the product to the flushing process. A third monitor can be located at the filler 38 to check that the PPM residual oxygen content has been achieved.

Figure 9:
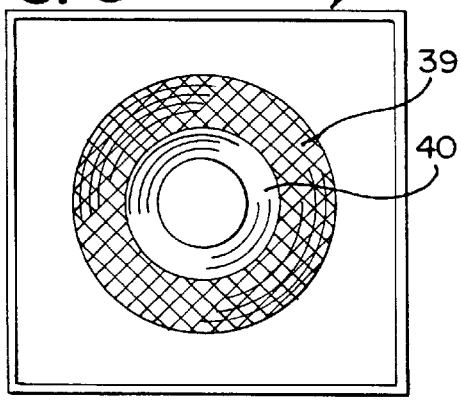
FIG. 9 is a bottom view of the filler having a filling head encircled by a purging screen.

Referring to FIG. 9, a bottom view of the filler 38 is shown having filler head 40 having an inner diameter of approximately 2.5 inches. Preferably, a 5-ply, 75 micron, approximately 3-inch wide laminated stainless steel screen 39 encircles the filling head 40 to provide a laminarized blanket of inert gas around the periphery of the filling head and downward over the container rim. This blanket effectively prevents air from entering the container as the product is released through the filling head 40 into the container.

Figure 10:
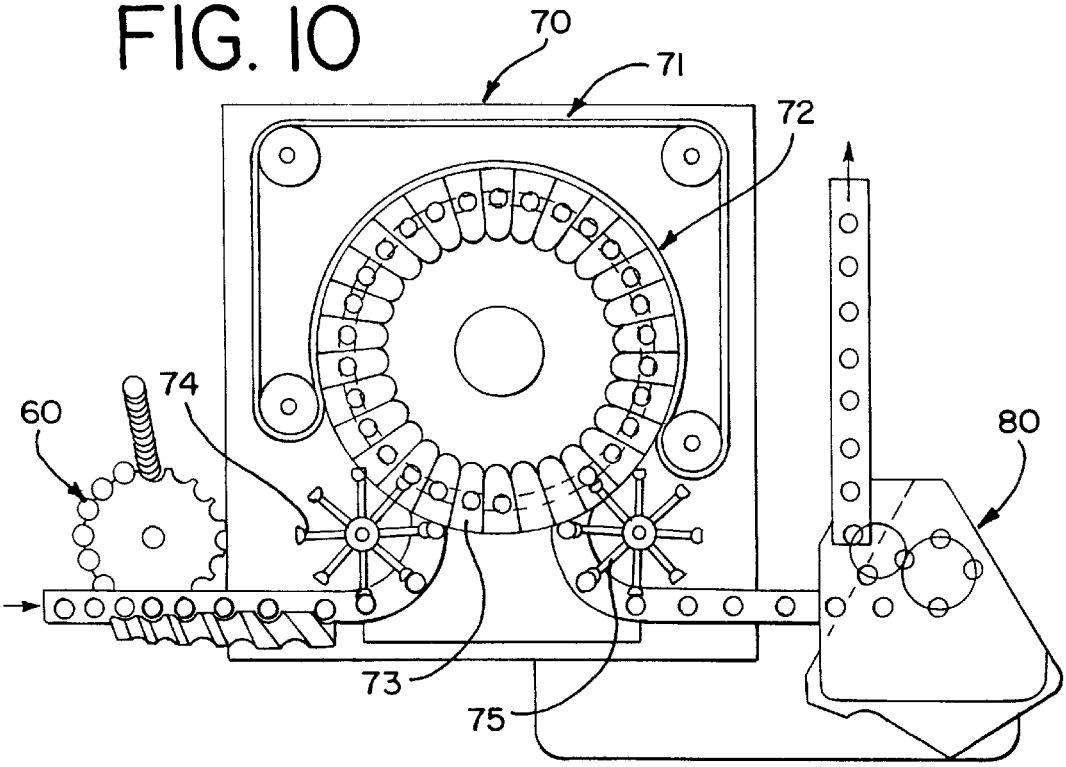
FIG. 10 is a top view of a preferred lid placement system, controlled environment processor, and permanent sealing station.

Referring to FIG. 10, a preferred lid placement system, controlled environment processor, and permanent sealing station are shown for a product requiring a vacuum pack. The preferred lid placement system is a high speed lid turret 60 which operates to place lids loosely on the open containers at high speeds, such as approximately 500 containers per minute. The lid turret 60 is preferably positioned adjacent the preferred controlled environment processor or Belt-Vac® processor 70. The Belt-Vac® 70 has a sealing belt 71, rotary drum 72, vacuum chambers 73, and entry and exit star wheels with suction cups, 74, 75. In operation, the container moves beneath the lid turret and a lid is placed loosely on its top. It should be understood that other forms or locations of lid placement may alternatively be employed without detracting from the scope of the invention, so long as the lid is available for pre-sealing after desired processing.

In the preferred embodiment illustrated, the container and lid are positioned by the entry star wheel 74 into a chamber 73 of a preferred 30-chamber Belt-Vac®. The rotary drum 72 and sealing belt 71 move in synchronization as the chamber 73 is evacuated in step-wise fashion. The permanent sealing station is preferably a standard atmospheric double seamer 80, which is located adjacent the Belt-Vac® 70. The Belt-Vac® may be driven off the seamer by a mechanical link.

In the preferred 30-chamber Belt-Vac® processor, the container and lid are subjected to a reduced pressure atmosphere that is incrementally increased over 14 chamber-lengths. For a 27 inch vacuum requirement, the vacuum would be increased in increments approximately 1.9 inches of mercury per chamber-length. After rotating 14 chamber lengths, the container would be returned to atmospheric pressure through a relief valve on the chamber. As the pressure returns to atmospheric the lid is pressed onto the container by the increasing pressure, creating a pre-seal. In the preferred embodiment, a plunger mechanism is used to apply pressure to a top portion of the lid after the container rotates approximately 14 chamber-lengths to assure intimate contact between the lid and container to provide a sufficient pre-seal. The additional force applied by the plunger helps to correct for any out of round condition in the container, to assure a secure pre-seal.

In the preferred embodiment, the inert gassing from the pre-purging and head-space purging rails, and the gassing in the filler station, reduce the vacuum requirement in the controlled environment processor. Alternatively for systems not requiring a vacuum-pack, the controlled environment processor would require only a lid placement system to apply a lid loosely on the filled container, and a mechanical sealing member to apply force to the lid and/or container to create the pre-seal. In inert or non-vacuum-pack packaging processes, the lid or container preferably includes gasket material, adhesive, or other sealing or seal-enhancing material to provide an adequate pre-seal to retain the inert environment in the absence of a pressure differential.

It should be understood that other forms of environmental processing may similarly be used either with or without pre-purging. For example, any known vacuum, inert gas, steam, or combination process may be used in conjunction with the pre-sealing of containers for subsequent permanent sealing.

It should also be understood that, used herein, pre-sealing is the temporary attachment of a lid to a container to retain within the container the vacuum and/or alternate environment for a sufficient time to allow the container to be transported through a contaminating environment and thereafter permanently sealed.

In the preferred embodiment, the pre-sealed container is transported approximately 2.8 seconds in the contaminated ambient environment before it is permanently and hermetically sealed by a standard atmospheric double seamer 80. Alternatively, the pre-sealed container could be transported for longer periods, and/or transported to an air table or other buffer zone to await permanent sealing. It should be understood that the non-essential optional use, in whole or in part, of the controlled environment transportation or seaming would not depart from the scope of the present invention.

Figure 11:
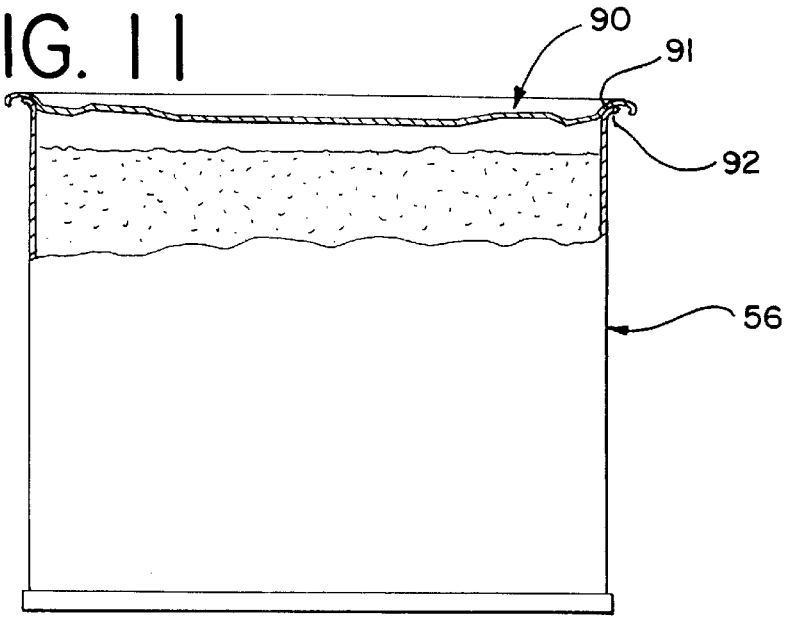
FIG. 11 is a side partial sectional view of a pre-sealed container.

Referring to FIG. 11, a side sectional view of a pre-sealed seam-on lid 90 and container 56 is shown. The standard 401 coffee container has a length of approximately 5.438 inches, an outer diameter of 3.906 inches, and a thickness of 0.009 inches. The flange 92 extends around the container opening and has an outside diameter of approximately 4.1 inches. A seam-on lid 90 is shown pre-sealed to the container. The lid has a draw portion 91 which mates with the inner surface of the container.

Figure 12:
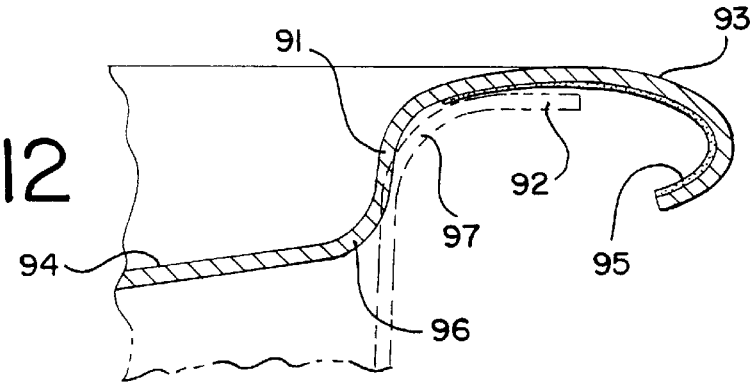
FIG. 12 is an enlarged sectional view of a standard seam-on lid shown integrated with a standard 401 coffee container.

Referring the FIG. 12, an enlarged sectional view of a standard seam-on coffee lid is shown integrated with the standard 401 coffee container. Both the standard seam-on lid and the standard 401 coffee container maybe used in the pre-sealing process as described. The standard seam-on lid has a draw portion 91, a curl portion 93, and a circular center portion 94. It has an outer diameter of 4.285 inches and a thickness of 0.009 inches. From a top surface of the container flange 92 to the bottom of the lid countersink 96 is approximately 0.096 inches. This provides only a small mating surface between the draw portion of the lid 91 and the inner surface of the container. This mating surface is on the upper flange radius 97 and therefore may be susceptible to indentations and other imperfections resulting from shipping and handling. Adhesive or gasket material 95 is placed on the underside of curl 93 and extends only to an upper portion of the flange radius to enhance the double seam. Accordingly, the gasket mating surface would be in a region of the flange that is susceptible to imperfections. The standard lids have a contour that is not complimentary to the contour of the inner container surface and flange radius 97. In addition, there is only a small region of the lid that would provide an interference fit with the container. Thus, although such lid/container combinations may be used in conjunction with the present invention, most of the gasket material will accordingly not be compressed during the pre-sealing operation to enhance the seal.

Figure 13:
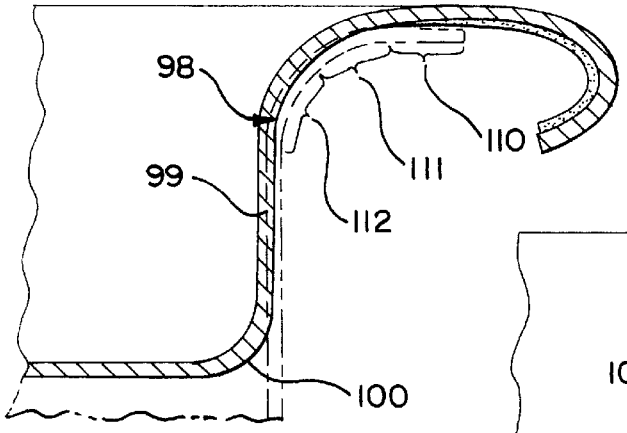
FIG. 13 is an enlarged sectional view of a preferred seam-on lid having an extended draw portion shown integrated with a standard 401 coffee container.

Referring to FIG. 13, an enlarged sectional view of a preferred seam-on lid, which similarly may be used in the pre-sealing process, is shown integrated with the standard 401 coffee container. The preferred lid has a draw portion 99 which is slightly longer than the standard lid draw 91. This provides a smooth mating surface that is both greater than the standard lid and a portion of which is located below the flange radius 97 (which is comprised of upper flange radius 111 and lower flange radius 112), which will eliminate sealing problems due to imperfections on the flange surface caused by shipping and handling. In particular, most dents or other imperfections will occur in the exposed flange 110 and/or upper flange radius 111, which are exposed. In contrast, lower flange radius 112, and the interior of the can adjacent and below portion 111, are relatively protected and typically not damaged. The lid is preferably contoured to conform more completely to the lower flange radius 111 of the container. This complimentary contour combined with the extended draw provides a greater mating surface area to allow for a tighter pre-seal.

In addition, a gasket material or glue strip 98 is, in the most preferred embodiments, strategically placed on at least the underside of the curl portion which is complimentary to the lower flange radius 111. In use, as the lid is pressed against the container by the differential pressure, the flared or conical cooperating lower flange radius surfaces will be pressed tightly together. Placement of gasket, adhesive or other seal-enhancing materials at this location is therefore highly advantageous. As the pressure differential increases, the force acting between these surfaces likewise increases, resulting in a more secure pre-seal.

The lid and container may further have an approximately 0.009 inch overlap to allow for an interference fit if desired. Moreover, the countersink 100 has an increased radius over the standard 0.035 inch countersink radius of the standard end to facilitate entry of the lid into a misshapen container opening. Gasket or adhesive material may also be provided under the curl to facilitate secure double seaming. During pre-sealing the lid will be pressed onto the container by the differential pressure and/or be forced in place by a plunger or other mechanical device. The lid and container overlap (if present) provides for an interference fit which tightly squeezes the glued or gasket area to retain the inert and/or vacuum environment within the container.

Alternatively a gasket material could be applied about the draw portion of a standard lid to enhance the pre-seal. A food grade material including vegetable oil or sterile water could also be distributed about the contact region of the container and/or draw portion of the lid to enhance the pre-seal, either in conjunction with or in lieu of a gasket material.

Figure 14:
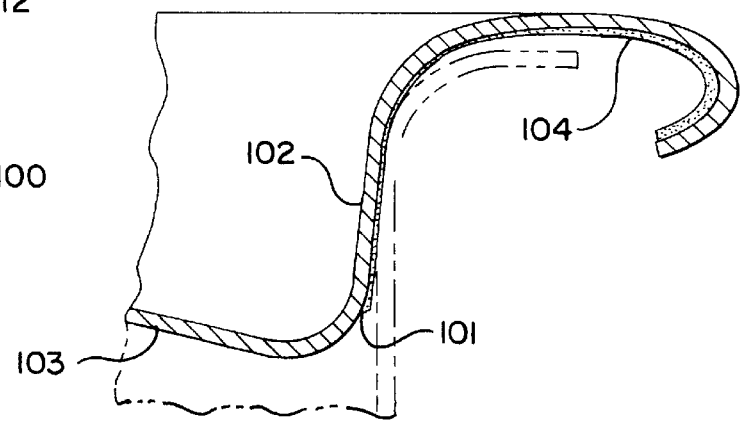
FIG. 14 is an enlarged sectional view of a preferred seam-on lid having a domed center portion shown integrated with a standard 401 coffee container.
Figure 15:
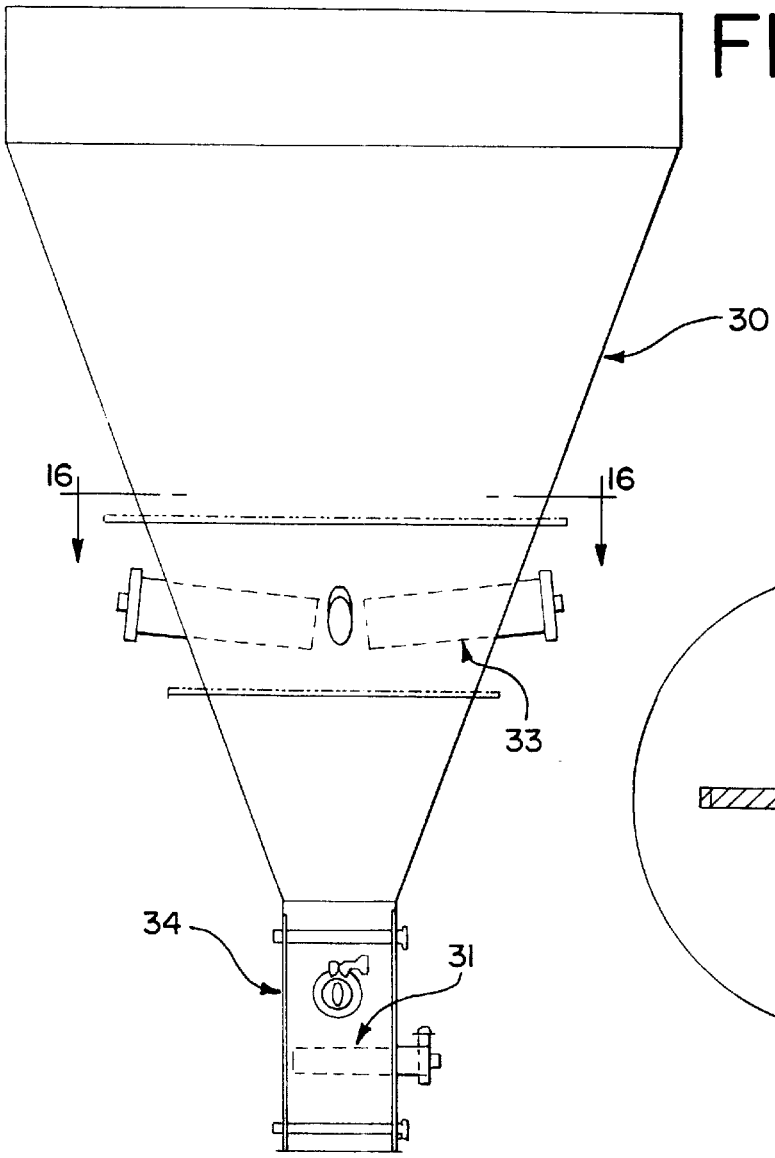
FIG. 15 is a side elevational view of the hopper and transfer chute with the gassing elements shown in phantom.
Figure 16:
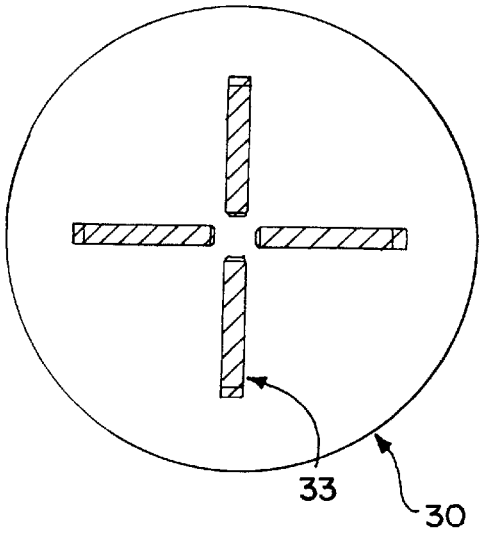
FIG. 16 is a sectional view taken along line 16—16 of FIG. 15.

An alternative lid embodiment is shown in FIG. 14. Adhesive or gasket material 101 is provided on the draw portion 102, preferably near the countersink. As previously noted, this material will enhance the pre-seal of the lid to the container. Adhesive or gasket material 104 may also be provided on the lower curl section and on the curl portion to assure secure double seaming.

In the embodiment illustrated, center portion 103 is partially or completely domed in an upward direction relative to the interior of the container. When the interior of the container is processed at a vacuum, and the lid is thereafter pre-sealed to the container and exposed to higher (e.g. atmospheric) pressure, the force acting against the exterior may act to distort the lid and press the draw portion more tightly against the inner surface of the container. In some embodiments, this force may result at least in part from distortion resulting from displacement of the domed center portion 103 by the pressure differential. Advantageously, as the pressure differential between the interior of the container and the ambient environment is increased, the force acting against the inner diameter of the container is likewise increased, and causes a more secure seal between the draw portion 102 and the inner surface of the container.

In particular embodiments, the lid may be dimensioned to provide less interference with the opening of the container on initial insertion into the container, with the necessary sealing interferences thereafter provided by the outward distortion of the lid as described above. Of course, mechanical interference may be provided if desired, and the specific angle of the draw portion 99 may differ from the diagrammatic illustration of the illustrations. Further, it should be understood that the cross-sections of the lid and/or container opening may differ from those illustrated without departing from the spirit and scope of the present invention.

It should further be understood that the inert gas flushing process discussed above, including pre-purging, head-space purging and filler station flushing (alone or in combination), may be used with processing and sealing processes other than the preferred pre-sealing processes discussed herein.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A container sealing system comprising:

a pre-purging rail including a longitudinally oriented plenum extending over a conveyer, and a longitudinally oriented manifold formed in a bottom portion of the plenum for providing a laminarized flow of inert gas into openings of containers being transported along the conveyer, the manifold having a width less than a width of the container openings;

a filling station having a hopper, and a filler, said hopper including a top, bottom and side portion including a plurality of gassing elements extending through the side portion of the hopper, the gassing elements providing a laminarized flow of inert gas into the hopper, said filler including a filling head opening and a gassing region adjacent to and encircling the filling head opening for providing a laminarized flow of inert gas that encircles the filling head opening;

a controlled environment pre-sealing station having a lid turret and a controlled environment processor positioned adjacent the lid turret, the lid turret positioning lids on the open container entering the controlled environment processor, the controlled environment processor pre-sealing the lids on the containers; and a permanent sealing station permanently sealing the pre-sealed containers in an air environment.

2. The system of claim 1 further comprising a head-space purging rail having a longitudinally oriented region providing a laminarized flow of inert gas into the filled open containers being transported along a conveyer.

3. The system of claim 1 wherein the permanent sealing station comprising a standard atmospheric double seamer.

4. The system of claim 1 wherein the controlled environment comprising a sub-atmospheric environment.

5. The system of claim 1 wherein the controlled environment processor having a plunger member applying pressure to a outer upper surface of the lid to engage a draw portion of the lid with a interior surface of the container.

6. A container sealing system comprising:

a purging rail including a longitudinally oriented plenum and a longitudinally oriented manifold formed in a bottom portion of the plenum to provide a laminarized flow of inert gas into openings of containers being transported along a conveyer, the manifold having a width less than a width of the container openings;

a filling station including a filler and a hopper, the hopper including a top, bottom, and side portion a plurality of gassing elements extending through the side portion of the hopper to provide a laminarized flow of inert gas into the hopper, the filler including a filling head opening and a gassing region adjacent to and encircling the filling head opening to provide a laminarized flow of inert gas that encircles the filling head opening;

a lid placement system to apply lids to the containers;

a plunger member to apply pressure to and pre-seal the lids placed on the containers after being filled; and a permanent sealing station positioned in an air environment to permanently seal the pre-sealed containers.

7. A container sealing system comprising:

a pre-purging rail including a longitudinally oriented plenum and a longitudinally oriented manifold formed in a bottom portion of the plenum for providing a laminarized flow of inert gas into openings of containers being transported along a conveyer, the pre-purging rail manifold having a width less than a width of the container openings;

a filling station having a hopper, and a filler, said hopper having a top, bottom and side portion, a plurality of gassing elements extending through the side portion of the hopper, the gassing elements providing a laminarized flow of inert gas into the hopper, said filler having a filling head opening and a gassing region adjacent to and encircling the filling head opening for providing a laminarized flow of inert gas that encircles the filling head opening;

a head-space purging rail including a longitudinally oriented plenum including a longitudinally oriented manifold formed in a bottom portion of the plenum for providing a laminarized flow of inert gas into the openings of filled containers being transported along a conveyer, the head-space purging rail manifold having a width less than the width of the container openings;

a lid placement system to place a lid on a container;

a mechanical sealing member to apply force to the lid or container to pre-seal the lid to the container; and a permanent sealing station positioned in an air environment to permanently seal the lid to the container.

* * * * *